United States Patent [19]

Gallo

[11] 4,066,098

[45] Jan. 3, 1977

[54] MARINE LOADING AND BUNKERING ARRANGEMENT

[75] Inventor: Donald J. Gallo, Whippany, N.J.

[73] Assignee: Exxon Research & Engineering Co., Linden, N.J.

[21] Appl. No.: 731,085

[22] Filed: Oct. 8, 1976

[51] Int. Cl.[2] ..... B67D 5/04

[52] U.S. Cl. ..... 137/615; 114/74 R; 137/344; 137/799; 141/387

[58] Field of Search ..... 114/74 R; 137/266, 344, 137/561 A, 615, 798, 799; 141/279, 387, 388

[56] References Cited

U.S. PATENT DOCUMENTS 3,409,046 11/1968 Means ..... 137/615

*Primary Examiner*—Martin P. Schwadron
*Assistant Examiner*—Gerald A. Michalsky
*Attorney, Agent, or Firm*—F. Donald Paris

[57] ABSTRACT

An articulated branch assembly comprising pipe member and appropriately arranged combinations of fluid carrying swivels, ball joints, or rubber hose is fixed to the outboard end of a conventional marine cargo loading arm. The branch assembly is used for bunkering vessels while the arm is supported off the cargo manifold adjacent to the bunker manifold. Fitting marine cargo arms with the bunkering assembly and supporting the arm off the cargo manifold permits, for a large percentage of vessels, simultaneous bunkering and cargo transfer through the other cargo arms in the bank. The branch assembly also: eliminates in many cases the need for a separate bunker arm(s), avoids overstressing of the smaller, weaker bunker manifolds, and makes the bunker manifolds more accessible without resorting to long lengths of hose or auxiliary bunkering saddles.

10 Claims, 5 Drawing Figures

MARINE LOADING AND BUNKERING ARRANGEMENT

BACKGROUND OF THE INVENTION

To provide service to tankers, many marine terminals equip their berths with all-metal bunker arms on one or both sides of the bank of cargo transfer arms. These bunker arms are installed at the berth with the intent that bunkering of the vessel, i.e., loading with fuel to power the vessel, can be accomplished quickly, economically, and without inconvenience to the terminal or vessel. Experience indicates, however, that for various reasons bunkering operations with the bunker arms often are not effective and cause delays to the departure of the vessel. The specific reasons encountered for difficulty in bunkering vessels directly with all-metal bunker arms include poorly designed and poorly located bunker manifold connections.

On many tankers, the bunker manifold connection is weak because of the use of: cast iron material, too small a flange and pipe diameter, and excessive overhang of the manifold from its deck support. Past analyses show that the all-metal bunker arms frequently create overstress in such manifolds and, therefore, the bunker arms cannot be used without the risk of failing the bunker manifold or manifold flange.

In addition to being weak, many manifolds often are inaccessible because of the need to locate them away from deck obstructions or because of lack of forethought on the part of the designers. When this is the case, the all-metal bunker arm either cannot reach the manifold without interference or cannot service the bunker manifold safely because it's outside the envelope of the bunker arm. The arm's envelope is the volume in space representing the location of manifolds the arm can service without causing overstress in the arm or the manifold. Finally, vessel owners are reluctant to retrofit the vessels with stronger, accessible bunker manifolds because of the high costs involved.

Many attempts have been made by terminals to circumvent these bunker manifold problems, including:

1. Extending a string of long, heavy rubber dock hose from the piping at the berth platform to the ship's bunker manifold. Such long lengths of hose often cannot be properly supported or repositioned as the ship deck elevation changes with draft and tide. Consequently, the hose is subject to rupture from damage caused by kinking or pinching action against the dock or fenders. Stringing the hose also is time-consuming.

2. Carrying aboard the vessel a heavy bunkering saddle which contains a horizontal section of pipe flanged at each end. The saddle must be lashed to the vessel's deck in a location where the forward flange falls inside the bunker arm's envelope. Hose then must be strung on deck from the rear flange of the saddle to the bunker manifold. While less hose is involved than with the previous method, carrying the heavy saddle aboard and lashing it in place is time-consuming and awkward. Further, since the vessels are not normally designed for mounting a saddle, it raises the question whether the marine arm is provided with a safe and substantial support while connected to the saddle.

3. Carrying aboard a special tee piece that is bolted to the cargo manifold adjacent to the bunker manifold and then connecting the bunker arm to this tee piece. A hose is run from the side outlet of the tee to the bunker manifold. The disadvantage to this method is the effect of carrying aboard the tee piece and the generation of higher stresses in the cargo manifold because of the increased overhang equivalent to the body length of the tee piece. The body length can be substantial because the bunker arm is usually made in a smaller diameter than the cargo manifold, making a long reducer section necessary.

4. Relocating the vessel at the conclusion of cargo transfer operations from its original berth to another berth with better bunker facilities. The practice of relocating the vessel can cause a substantial debit in turnaround time and berth occupancy rate.

Thus it is apparent that there still exists a need for a bunkering device that will accomplish quick, economical and convenient bunkering of vessels at conventional marine berths.

SUMMARY OF THE INVENTION

The present invention relates to a device for providing improved loading of a vessel with bunker fuel, which in some instances will eliminate the need for at least one of the bunker arms normally employed. It also permits the simultaneous bunkering and transfer of cargo for a large percentage of vessels not heretofore obtainable, thus reducing vessel turnaround time and avoiding overstress in the bunker manifold. The present invention overcomes the limitations and deficiencies of the prior art by providing a novel and improved articulated branch attachment fitted to the outboard end of the marine cargo loading arm. According to the present invention, either of the bunker arms (frequently there are two bunker arms employed in a typical bank of marine loading arms) or the outside cargo arm or arms within a bank of arms in those instances where cargo transfer requirements permit (which is when not all the cargo arms have to be used for certain vessels to achieve the desired cargo transfer rate) are fitted with a relatively small diameter flanged outlet which is preferably located in the triple swivel assembly of the loading arm. An all-metal (aluminum or steel) bunkering assembly then is secured to the outlet, comprising according to a preferred embodiment of the invention a swivel joint, a first fluid-carrying ball joint, a relatively short straight length of pipe, a second fluid-carrying ball joint and a bunker outlet flange for connection to the bunker manifold on the vessel. The ball joints and swivel permit movement of the bunker assembly so that connections can be made to the bunker manifold when it is located at various positions onboard the vessel. The flexible components also preclude damage to the branch assembly and/or loading arm itself from motion of the vessel. While the arm is in its stored position or when it is being used for cargo transfer, a pressure-tight blanking plate is secured to the flanged outlet. The advantage of using the branch assembly for bunkering is that during bunkering the arm itself is connected to the adjacent but larger and stronger cargo manifold for support purposes and not directly to the smaller and weaker bunker manifold. During bunkering another blanking plate can be sandwiched between the outboard flange of the triple swivel assembly and the cargo manifold flange to preclude any bunker fuel from entering the cargo tanks.

According to another embodiment of this invention, an auxiliary pipe spool can be provided if necessary to increase the coverage or extent of the bunker outlet flange which is connected to the bunker manifold. It is also possible to employ relatively short lengths of hose either in lieu of some of the components mentioned heretofore (e.g., part or all of the straight pipe, swivel or ball joints) or in combination therewith. A typical application would be to run the hose from the small diameter flanged outlet in the triple swivel assembly or from the end of the first swivel in the bunker assembly to the bunker manifold. The use of variations to the basic invention does not detract from its primary concept, namely supporting the loading arm while used for bunkering off the stronger and safer cargo manifold, thereby avoiding the use of long hose strings, saddles, etc.

The use of the bunkering system according to the present invention has the advantage of providing increased safety due to proper support of the loading arm while it is used during bunker service by virtue of its being connected to the cargo manifold as compared with the normal poorly supported saddle or by the weaker and smaller bunker manifold. Also, the need for manual handling of long strings of hose which as susceptible to damage and unexpected failure are avoided. Still another advantage is that the total cargo transfer capacity of the particular berth can be increased because the bunker arms can still be of the same diameter as the cargo arms, whereas presently the bunker arm is usually made in smaller diameters to minimize stresses occurring in the bunker manifold. It also may be possible to install a lesser number of arms per bank of arms and thereby reduce the platform size, since the two outer arms which are normally for bunker purposes can comprise cargo loading arms equipped with a bunker assembly according to the present invention. A further advantage is the reduction of the possibility of clashing, i.e., the physical interference or contact between the arms, which is less likely as the number of arms in the bank decreases.

These and other objects and advantages and the construction, arrangement and operation of the present invention will be apparent from the detailed description of the invention which follows in and which will be more fully understood when considered in conjunction with the accompanying drawings.

DESCRIPTION OF THE PREFERRED EMBODIMENT

Figure 1:
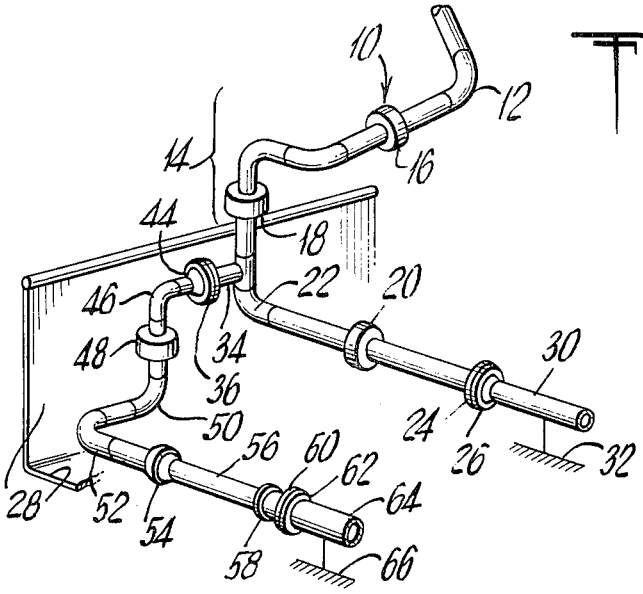
FIG. 1 is a schematic perspective view of a marine loading arm connected at its outboard end with a bunkering device constructed and arranged according to the present invention.
Figure 2:
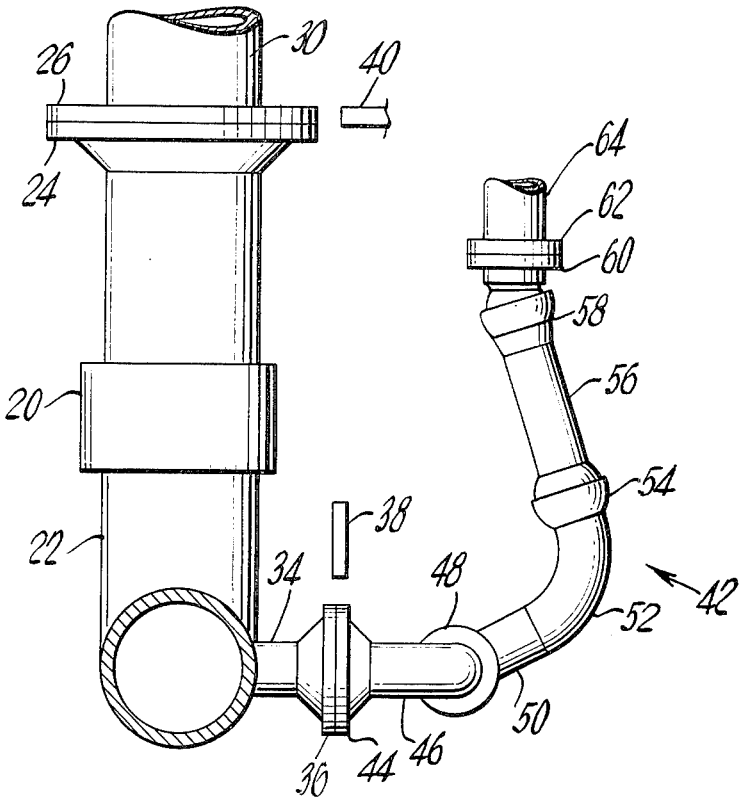
FIG. 2 is a top plan view of the bunkering device of FIG. 1.
Figure 3:
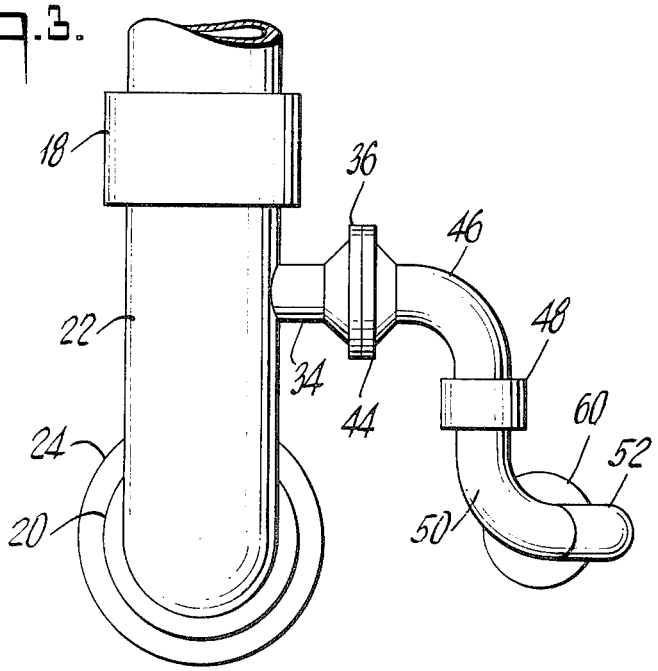
FIG. 3 is a rear eleveation view of the bunkering device of FIG. 1.

Referring now to the drawings wherein like components are designated by the same reference numeral throughout the several views, there is shown in FIG. 1 an illustration of a typical marine loading arm 10 (shown in part) including an outboard arm 12 and the usual triple swivel assembly generally designated 14. The triple swivel assembly includes a horizontal swivel 16, a vertical swivel 18 and a manifold swivel 20. These three swivels and the elbow 22 all are located at the end of the outboard arm. In some designs the manifold swivel 20 is located between swivel 16 and swivel 18. The present invention has utility with any type of conventional loading arm regardless of the swivel locations. These arms are well known in the art and therefore no further disclosure thereof is deemed necessary in this application. Reference may be had to various publications including U.S. Pat. Nos. 3,085,593 and 3,073,343 for further details on the general makeup of conventional loading arms. In addition to the outboard arm, the loading arm includes an inboard arm coupled by an articulated fluid-carrying joint situated between the inboard and outboard arms and the opposite end of the inboard arm is connected to the primary counterweight as well as through a horizontal swivel which is connected to a vertical swivel at the upper end of the riser which is the vertical assembly on the shore loading platform that supports the inboard and outboard assemblies. A riser base mounts the riser on shore. None of these latter loading features have been illustrated because they are conventional. The outboard arm 12 extends from shore over the vessel's side and is secured through the triple swivel assembly 14 to a cargo manifold flange 26 which is on the deck 28 of the vessel and situated at the end of the cargo manifold piping 30. The manifold comprises a cast iron or steel pipe assembly 30 mounted onboard the ship and to which the outboard flange 24 of the loading arm is connected. While only one cargo manifold is shown, typically there are several cargo manifolds which comprise the cargo manifold groups and which are generally located midship on the particular vessel. The manifold swivel 20 which forms part of the triple swivel assembly 14 is a horizontally disposed swivel which permits rotation of the ship's manifold due to pitching of the vessel with respect to the loading arm. Basically, each of the swivels comprises a swing joint contained within the loading arm in order to permit the arm to freely follow the motion of the vessel while it is berthed. These are essentially conventional swivels and typically comprise male and female housings, containing ball raceways and ball bearings to permit rotation and carrying loads. A standard liquid seal is disposed between the housings in order to prevent any leakage. Typically, the cargo manifold is supported at a location schematically shown at 32 onboard the deck of the tanker or vessel in question. The bunkering device according to the present invention is secured to the triple swivel assembly 14 of the marine loading arm 10 at a location between components 18 and 24, the exact location depending on the spatial requirements for fitting the bunker device so that it is accessible to the bunker manifold 62. This is accomplished by means of a relatively small diameter nipple 34 and flanged outlet 36 which can be the same or slightly smaller than the smallest bunker manifold to be serviced to reduce weight. A smaller branch assembly is permissible since the higher pressure drop in the branch assembly is offset by the lower pressure drop in the cargo arm which is usually of a larger diameter than the bunker arms normally supplied. A pressure-type blanking plate 38 (shown detached in FIG. 2) would be fitted to the outlet flange 36 when the arm is stored or used for cargo transfer. This permits cargo to flow through the cargo manifold and not through the bunkering device. As shown, during bunkering the loading arm is connected to its cargo manifold which provides a relatively strong support for the arm as well as the bunker device.

During bunkering, a blanking plate 40 (shown in part detached in FIG. 2) would be disposed between triple swivel assembly outboard flange 24 and the cargo manifold flange 26 to preclude bunker fuel from entering the cargo tanks.

When bunkering is taking place, the blanking plate 38 is removed and the bunkering assembly generally designated 42 is secured in place if necessary. It may be practical in a number of instances such as when the manifold spacing and the arm size permit it, i.e., when the arm is strong enough to carry the extra weight, to permanently fix the assembly 42 to the cargo arm; however, it can be removably mounted. This would merely require that the proper connection be provided on at least one of the arms within each bank of arms. The assembly 42 includes a flange 44, an elbow 46 connected to a vertical fluid-carrying swivel 48, which in turn is connected to an elbow grouping composed of elbows 50 and 52, joined at right angles to each other. Fluid-carrying ball joint 54 is connected to the end of elbow 52. A relatively short length of straight pipe 56 connects the first fluid-carrying ball joint 54 to a second fluid-carrying ball joint 58. The end of the bunker branch assembly 42 is fitted with a flange 60 which is connected to the bunker manifold flange 62 when bunkering is required. Bunker manifold flange 62 is fitted to the end of the bunker manifold 64, which in turn is supported to the tanker deck at a location schematically shown at 66.

Figure 4:
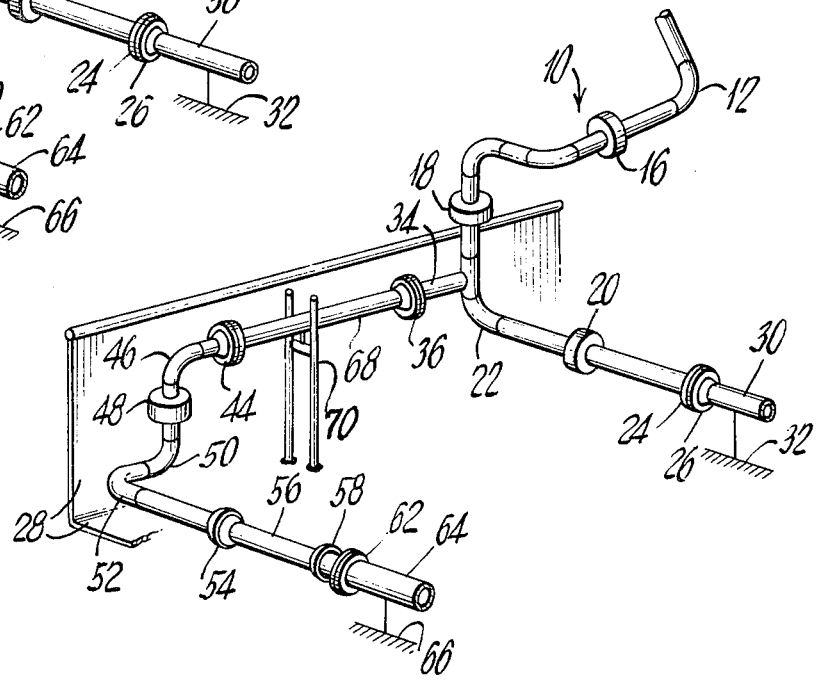
FIG. 4 is a schematic perspective view of the bunkering device which also incorporates an auxiliary spool section.

Fluid-carrying swivel 48 and fluid-carrying ball joints 54 and 58 are incorporated in the assembly 42 to accommodate variations that occur from tanker-to-tanker in the location of the bunker manifold flange 62 relative to the cargo manifold flange 26. Rotation of components 48, 54 and 58 permits connection to bunker manifold flange 62 should it be forward of or to the rear of cargo manifold flange 26. These same rotational components (48, 54 and 58) also permit connection of the assembly 42 despite variations which might be encountered in the lateral displacements between the cargo manifold 30 and the bunker manifold 64. Should the lateral displacement be great, then an auxiliary flanged pipe spool 68 can be inserted between outlet flange 36 on the cargo arm and flange 44 on the branch assembly 42 as shown in FIG. 4. Depending on the length of the auxiliary pipe spool 68 and the weight of the branch assembly 42, a vertically adjustable support 70 could be used to limit the load caused on the bunker flange 62 and/or bunker manifold 64.

Rotational components 48, 54 and 58 also prevent stresses from occurring in the bunker manifold 64 or the loading arm triple swivel assembly 14 due to pitching of the vessel (rotation of the vessel about an axis parallel to the longitudinal axis of the cargo manifold 30).

Figure 5:
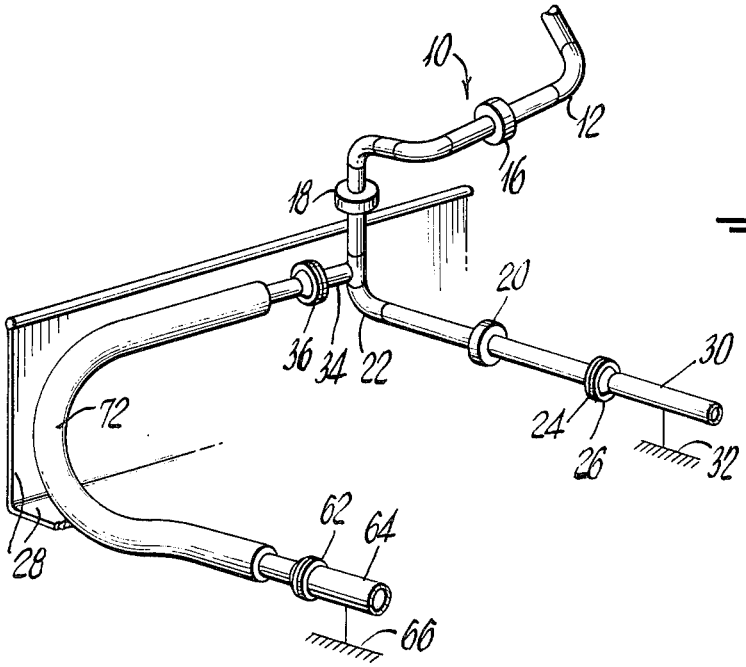
FIG. 5 is a schematic perspective view of the bunkering device when a hose is employed instead of ball joints or swivels.

It is quite obvious from the foregoing that the layout of the various fittings and the layout of different combinations of articulated components is within the contemplation of the present invention. Still yet a further variation may comprise the use of a short length of hose 72 such as shown in FIG. 5. This has the advantage in those instances where the lateral and/or longitudinal displacement of the bunker manifold flange 62 would require too large a bunker assembly 42 to be easily handled and installed.

While a preferred embodiment of the invention has been shown and described and various modifications thereof suggested, it will be understood that the true spirit and scope of the invention is set forth in the appended claims, which embrace other modifications and embodiments which will occur to those of ordinary skill in the art.

What is claimed is:

1. A cargo loading arm for use in the transfer of cargo to and from a vessel having a cargo manifolds and a bunker manifold onboard, said arm comprising an outboard arm and a triple swivel assembly including a manifold connected to said cargo manifold onboard said vessel, wherein the improvement comprises: a bunkering assembly connected at a first end to said loading arm and at the opposite end thereof coupled to said bunker manifold, said bunkering assembly containing flexible components for accommodating various locations of said bunker manifold and movement of said vessel during bunkering and cargo transfer.

2. The loading arm of claim 1 wherein said bunkering assembly is secured at said first end to said loading arm triple swivel assembly and at said opposite end to said bunker manifold on said vessel.

3. The loading arm of claim 1 wherein said triple swivel assembly includes a vertical swivel and a horizontal manifold swivel, said horizontal swivel having its axis of rotation parallel to said vessel cargo manifold, said bunkering assembly connected at said first end between said vertical and said horizontal manifold swivels and at said opposite end to said bunker manifold on said vessel.

4. The loading arm of claim 1 wherein said bunkering assembly includes connected in seriatim a flanged outlet at said first end, a swivel joint, a first cargo-carrying ball joint, a straight pipe section, and a second cargo-carrying ball joint coupled to said bunker manifold on said vessel.

5. The loading arm of claim 1 wherein said bunkering assembly includes connected in seriatim a flanged outlet at said first end, a first cargo-carrying ball joint, and a second cargo-carrying ball joint coupled to said bunker manifold on said vessel.

6. The loading arm of claim 1 wherein said bunkering assembly includes connected in seriatim a flanged outlet at said first end and a flexible hose coupled to said bunker manifold on said vessel.

7. The system of claim 1 including means for supporting said bunkering assembly adjacent to said triple swivel assembly.

8. A system for the transfer of cargo and bunker fuel to a vessel comprising, in combination: a cargo loading arm including an outboard arm and a triple swivel assembly at the end thereof coupled to a cargo manifold supported on the deck of said vessel, a bunkering assembly coupled at a first flanged end to said triple swivel assembly of said outboard arm and at an opposite flanged end to a bunker manifold supported on said vessel, said bunkering assembly containing flexible components for accommodating various locations of said bunker manifold and movement of said vessel during cargo transfer and bunkering operations.

9. The system of claim 8 including means for supporting said bunkering assembly adjacent said triple swivel assembly.

10. The system of claim 8 wherein said bunkering assembly comprises a flanged outlet portion connected to said outboard end of said loading arm, swivel joint means disposed in a vertical portion of said assembly and connected to a first ball joint means disposed in a horizontal portion of said assembly, said first ball joint means connected to conduit means at the end thereof, and a second ball joint means connecting said conduit means to said bunker manifold.

* * * * *

UNITED STATES PATENT OFFICE

CERTIFICATE OF CORRECTION

PATENT NO. : 4,066,098

DATED : January 3, 1978

INVENTOR(S) : Donald J. Gallo

It is certified that error appears in the above-identified patent and that said Letters Patent are hereby corrected as shown below:

On the cover sheet, Item 45, change "Jan. 3, 1977" to read as --Jan. 3, 1978--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*